US010759555B2

(12) United States Patent
Buscema et al.

(10) Patent No.: US 10,759,555 B2
(45) Date of Patent: Sep. 1, 2020

(54) METHOD FOR FORMING A SHIPPING CONTAINER CONVERTIBLE INTO A DISPENSER CONTAINER OR A DISPLAY TRAY

(71) Applicant: WestRock Shared Services, LLC, Atlanta, GA (US)

(72) Inventors: Craig W. Buscema, Douglasville, GA (US); David G. Couture, Suwanee, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 304 days.

(21) Appl. No.: 15/891,553

(22) Filed: Feb. 8, 2018

(65) Prior Publication Data

US 2018/0162575 A1 Jun. 14, 2018

Related U.S. Application Data

(62) Division of application No. 14/599,224, filed on Jan. 16, 2015, now Pat. No. 9,994,344.

(60) Provisional application No. 61/929,823, filed on Jan. 21, 2014.

(51) Int. Cl.

| | |
|---|---|
| ***B65B 43/10*** | (2006.01) |
| ***B65D 5/72*** | (2006.01) |
| ***B65D 5/16*** | (2006.01) |
| ***B65D 5/68*** | (2006.01) |
| ***B65D 5/18*** | (2006.01) |
| ***B65D 5/32*** | (2006.01) |

(52) U.S. Cl.

CPC ..... *B65B 43/10* (2013.01); *B65D 5/16* (2013.01); *B65D 5/18* (2013.01); *B65D 5/322* (2013.01); *B65D 5/68* (2013.01); *B65D 5/72* (2013.01); *B65D 5/725* (2013.01); *B65D 5/321* (2013.01)

(58) Field of Classification Search

CPC .. B65B 43/10; B65D 5/16; B65D 5/72; B65D 5/725

USPC ..... 53/456, 169; 206/738; 221/302, 305

See application file for complete search history.

(56) References Cited

U.S. PATENT DOCUMENTS 2,472,871 A * 6/1949 Williamson ..... B65D 83/0409 221/263
3,416,719 A * 12/1968 Pilger ..... B65D 5/38 229/117.15

(Continued)

FOREIGN PATENT DOCUMENTS

EP 0637548 A1 * 2/1995 ..... B65D 5/68
FR 2415051 A1 * 8/1979 ..... B65D 5/725

(Continued)

*Primary Examiner* — Stephen F. Gerrity

(74) *Attorney, Agent, or Firm* — WestRock Intellectual Property Group

(57) ABSTRACT

A convertible shipping container for goods includes a tray portion that includes a first wall. The first wall is configured to be oriented as a front wall of the convertible shipping container in a first display configuration and as a bottom wall of the convertible shipping container in a second display configuration. The convertible shipping container also includes a cover portion removably coupled to the tray portion such that the cover portion is coupled to the tray portion in the first display configuration and is detachable from the tray portion to form the second display configuration.

13 Claims, 5 Drawing Sheets

(56) References Cited

U.S. PATENT DOCUMENTS 3,715,072 A * 2/1973 Muskopf ..... B65D 5/4804 229/120.37
4,138,052 A * 2/1979 Torigian ..... B65D 5/542 206/443
4,566,607 A * 1/1986 Smith ..... B65D 83/0847 221/305
5,020,670 A * 6/1991 Bedford ..... B65D 5/72 206/499
6,062,424 A * 5/2000 Simile-Gravina ..... B65D 5/725 206/746
6,951,300 B2 * 10/2005 Caille et al. ..... B65D 5/722 229/121
7,648,048 B2 * 1/2010 Smith ..... B65D 71/36 221/302
8,281,981 B2 * 10/2012 Foden ..... B65D 5/542 229/121
8,844,798 B2 * 9/2014 Linkel ..... B65D 5/542 229/121
9,169,039 B2 * 10/2015 Freeman ..... B65D 5/722
2003/0098344 A1 * 5/2003 Blake ..... B65D 5/722 229/122.1
2004/0182880 A1 * 9/2004 Lampe ..... B65D 5/725 221/303
2011/0127289 A1 * 6/2011 Workman ..... B65D 5/725 221/282
2012/0018503 A1 * 1/2012 Walling et al. ..... B65D 5/725 229/122.1

FOREIGN PATENT DOCUMENTS

FR 2626256 A1 * 7/1989 ..... B65D 5/725
FR 2815015 A1 * 4/2002 ..... B65D 5/322
WO WO-0063083 A1 * 10/2000 ..... B65D 5/68
WO WO-2005110890 A1 * 11/2005 ..... B65D 5/725

* cited by examiner

METHOD FOR FORMING A SHIPPING CONTAINER CONVERTIBLE INTO A DISPENSER CONTAINER OR A DISPLAY TRAY

CROSS REFERENCE TO RELATED APPLICATIONS

This is a divisional application of U.S. Non-Provisional patent application Ser. No. 14/599,224, filed on Jan. 16, 2015, now U.S. Pat. No. 9,994,344, which claims the priority of U.S. Provisional Patent Application Ser. No. 61/929,823, filed on Jan. 21, 2014, both of which are hereby incorporated by reference in their entirety.

BACKGROUND

The embodiments described herein relate generally to a blank assembly for forming a container from sheet material, and more particularly to methods for forming a shipping container from a blank assembly that is convertible into a dispenser container or a display tray.

Containers fabricated from paperboard and/or corrugated paperboard material are often used to store and transport goods. These containers can include four-sided containers, six-sided containers, eight-sided containers, bulk bins and/or various size corrugated boxes. Such containers are usually formed from blanks of sheet material that are folded along a plurality of preformed fold lines to form an erected corrugated container. In some cases, these containers can be used to ship goods, and then be used to display the goods at a merchant's store or business after the goods have been shipped to the merchant.

The practice of displaying goods for sale within their shipping containers is widespread, especially at outlet stores and supermarkets. This practice allows merchants of the goods to quickly move the goods from a dock or storage area and onto store shelves for display to consumers without arrangement of the stored products to the shelf. Often, a knife is used to cut away a top portion of a shipping container, in order to convert the shipping container into a display tray for the enclosed goods. This practice is often time consuming, may result in damage to the goods through inadvertent contact with the knife during this cutting, as well as dangerous to the individual cutting the box down into a tray. Moreover, this practice often results in a display tray having a ragged, unappealing visual appearance.

Furthermore, different merchants may have different size shelving or space allotment for particular goods. Such convertible containers may not fit within such allotment in their intended orientation, requiring that the products be removed from the container and arranged on the shelf. Moreover, a merchant may want to display a greater portion of the container to the consumer than is conventionally displayed with known convertible shipping containers. Finally, consumers may want a more convenient and efficient method of removing the product from the container than what is known in conventional convertible shipping containers.

Accordingly, it is desirable to have a convertible shipping container that provides various configurations and orientations to fit space allotments and shelving sizes for various merchants, displays a greater portion of the container to the consumer, and provides for more convenient removal of the product from the container

BRIEF DESCRIPTION

In one aspect, a convertible shipping container for goods is provided. The convertible shipping container includes a tray portion that includes a first wall. The first wall is configured to be oriented as a front wall of the convertible shipping container in a first display configuration and as a bottom wall of the convertible shipping container in a second display configuration. The convertible shipping container also includes a cover portion removably coupled to the tray portion such that the cover portion is coupled to the tray portion in the first display configuration and is detachable from the tray portion to form the second display configuration.

In another aspect, a method for forming a convertible shipping container for goods is provided. The method includes forming a tray portion from a tray blank. The tray portion includes a first wall. The method also includes removably coupling a cover portion to the tray portion and selectively orienting the tray portion in one of a first display configuration and a second display configuration. The first wall is configured to be oriented as a front wall of the convertible shipping container in the first display configuration, and as a bottom wall of the convertible shipping container in the second display configuration. The cover portion is coupled to the tray portion in the first display configuration and is detachable from the tray portion to form the second display configuration.

DETAILED DESCRIPTION OF THE DISCLOSURE

Figure 1:
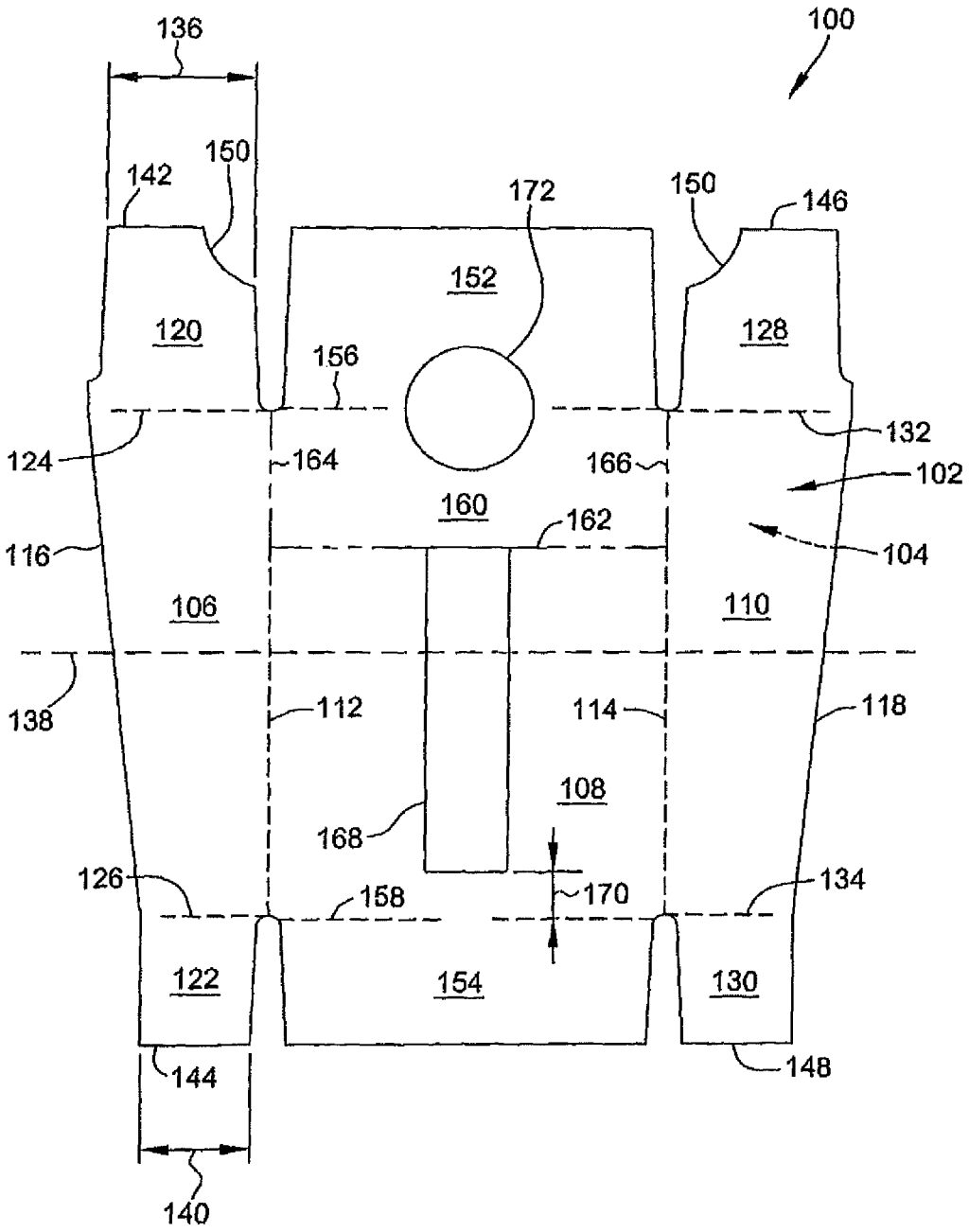
FIG. 1 is an exterior view of an example embodiment of a tray blank of sheet material that may be used to form the shipping dispenser container described herein.

The following detailed description illustrates the shipping container selectively convertible into a dispenser container or a display tray (referred to herein as the "shipping dispenser container") by way of example and not by way of limitation. The description clearly enables one skilled in the art to make and use the shipping dispenser container, and describes several embodiments, adaptations, variations, alternatives, and uses of the shipping dispenser container, including what is presently believed to be the best mode of carrying out the shipping dispenser container.

The present disclosure provides a container formed from a blank assembly of sheet material. The blank assembly includes a tray blank and a cover blank that are coupled together to form a container, sometimes referred to as a Retail Ready Package (RRP), that includes a tray portion and a cover portion. In the example embodiment, the shipping dispenser container is configured to be used as a shipping container that can be converted into a display tray configuration or into a gravity-feed dispenser configuration. Accordingly, as used herein, the container is referred to as the "RRP shipping dispenser container" or the "shipping dispenser container." The shipping dispenser container described herein is sometimes referred to as a four-sided RRP container, but any number of sides of a container could be formed including, but not limited to, an eight-sided or a six-sided container.

In one embodiment, the shipping dispenser container is fabricated from a paperboard material, such as one of a corrugated paperboard material, a folding carton paperboard material, or a combination of corrugated and folding carton paperboard material. The shipping dispenser container, however, may be fabricated using any suitable material, and therefore is not limited to a specific type of material. In alternative embodiments, the shipping dispenser container is fabricated using cardboard, fiberboard, paperboard, foamboard, corrugated paper, and/or any suitable material known to those skilled in the art and guided by the teachings herein provided. The shipping dispenser container may have any suitable size, shape, and/or configuration, whether such sizes, shapes, and/or configurations are described and/or illustrated herein. Further, different embodiments described here can vary in size and/or dimensions. The shipping dispenser container may also include lines of perforation for removal of a portion of the container for displaying articles for sale.

In an example embodiment, the shipping dispenser container includes at least one marking thereon including, without limitation, indicia that communicates the product, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the shipping dispenser container is void of markings, such as, without limitation, indicia that communicates the product, a manufacturer of the product, and/or a seller of the product.

Referring now to the drawings, FIG. 1 is an exterior view of an example embodiment of a tray blank 100 of sheet material that may be used to form the shipping dispenser container described herein. As explained below in more detail, tray blank 100 is coupled to another blank (a cover blank 200, shown in FIG. 2) to form a blank assembly that is used to form a shipping dispenser container 300 (shown in FIGS. 3-5). Tray blank 100 includes an exterior side 102 and an interior side 104. As shown in FIG. 1, tray blank 100 includes a series of aligned side panels and end panels connected together by a plurality of preformed, generally parallel, fold lines. Specifically, the side panels include a first side panel 106, an end panel 108, and a second side panel 110 connected in series along a pair of fold lines 112 and 114. First side panel 106 extends from a free edge 116 to fold line 112, end panel 108 extends between first and second side panels 106 and 110 from fold line 112 to fold line 114, and second side panel 110 extends from end panel 108 at fold line 114 to a second free edge 118.

A first side flap 120 and a second side flap 122 extend from opposing edges of first side panel 106. More specifically, first side flap 120 and second side flap 122 extend from first side panel 106 along a pair of opposing preformed, generally parallel, fold lines 124 and 126, respectively. Similarly, a third side flap 128 and a fourth side flap 130 extend from opposing edges of second side panel 110. More specifically, third side flap 128 and fourth side flap 130 extend from second side panel 110 along a pair of opposing preformed, generally parallel, fold lines 132 and 134, respectively. Fold lines 124, 126, 132, and 134 are generally parallel to each other and generally perpendicular to fold lines 112 and 114. Free edges 116 and 118 are oriented obliquely with respect to fold lines 112, 114, 124, 126, 132, and 134 such that first side flap 120 and third side flap 128 each have a width 136 taken along a central horizontal axis 138 of tray blank 100 that is greater than a width 140 of second side flap 122 and fourth side flap 130, also taken along central horizontal axis 138.

Figure 5:
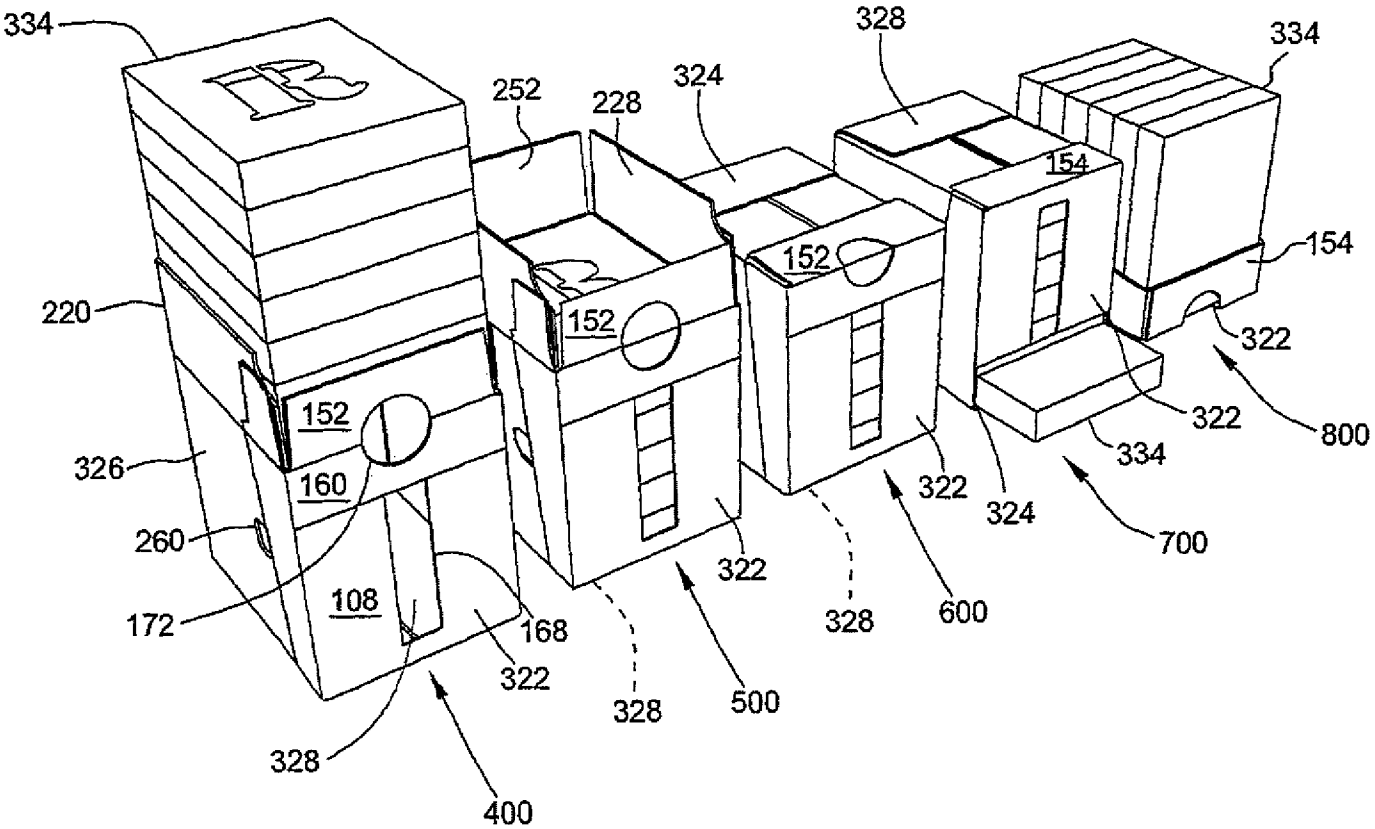
FIG. 5 is perspective view of the shipping dispenser container shown in FIGS. 3 and 4 during an example packing process.

First side flap 120 and second side flap 122 each include a free edge 142 or 144, respectively. Similarly, third side flap 128 and fourth side flap 130 each include a free edge 146 or 148, respectively. First side flap 120 and third side flap 128 each include an arcuate edge 150. Each arcuate edge 150 extends inwardly from free edge 142 or 146 towards axis 138. The shape, size, and arrangement of side flaps 120, 122, 128, and 130 as shown in FIG. 1 and described above facilitates forming a rectangular shipping dispenser container 300 having cutouts, as shown in FIG. 5.

As shown in FIG. 1, a first end flap 152 and a second end flap 154 extend from opposing edges of end panel 108. More specifically, first end flap 152 and second end flap 154 extend from end panel 108 along a pair of opposing preformed, generally parallel, fold lines 156 and 158, respectively. End panel 108 further includes a removable panel 160 extending from fold line 156 inwardly toward axis 138 to a perforated line 162. In the example embodiment, fold line 156 is also perforated and fold lines 112 and 114 include perforated portions 164 and 166, respectively. Removable panel 160 is detachable from end panel 108 such that a product stored within shipping dispenser container 300 may be removed, as described in further detail below.

End panel 108 may also include a first cutout 168 positioned approximately midway between fold lines 112 and 114. First cutout 168 is a substantially rectangular slot that extends from perforated line 162 and terminates a distance 170 from fold line 158. First cutout 168 is configured to function as a window to view product inside shipping dispenser container 300 when container 300 is in the gravity-feed configuration. Tray blank 100 further includes a second cutout 172 that is substantially circular and is positioned such that second cutout 172 extends into end panel 108 and first end flap 152. Specifically, end panel 108 and first end flap 152 each include a substantially semi-circular portion of second cutout 172 such that fold line 156 divides second cutout 172 into two substantially equal portions. Second cutout 172 is configured to facilitate removing removable panel 160 when the gravity-feed configuration of shipping dispenser container 300 is desired.

In the example embodiment, tray blank 100 is formed from a corrugated paperboard material. More specifically, tray blank 100 is formed from a corrugated paperboard material having an E flute size corrugation, which includes a flute thickness of approximately 1/16 inch (in.) and includes a plurality of flutes (not shown) oriented substantially parallel to fold lines 112 and 114. The plurality of flutes are configured in such an orientation to provide stacking strength to shipping dispenser container 300 during shipping and storage. Such a configuration is different from many known containers in that many known containers include flutes that would extend parallel to axis 138 in an orientation that enables the flutes to have the longest possible length.

Alternatively, tray blank 100 may be formed from any size flute paperboard material that facilitates operation of shipping dispenser container 300 as described herein, or tray blank 100 may be formed from a folding carton paperboard material.

Figure 2:
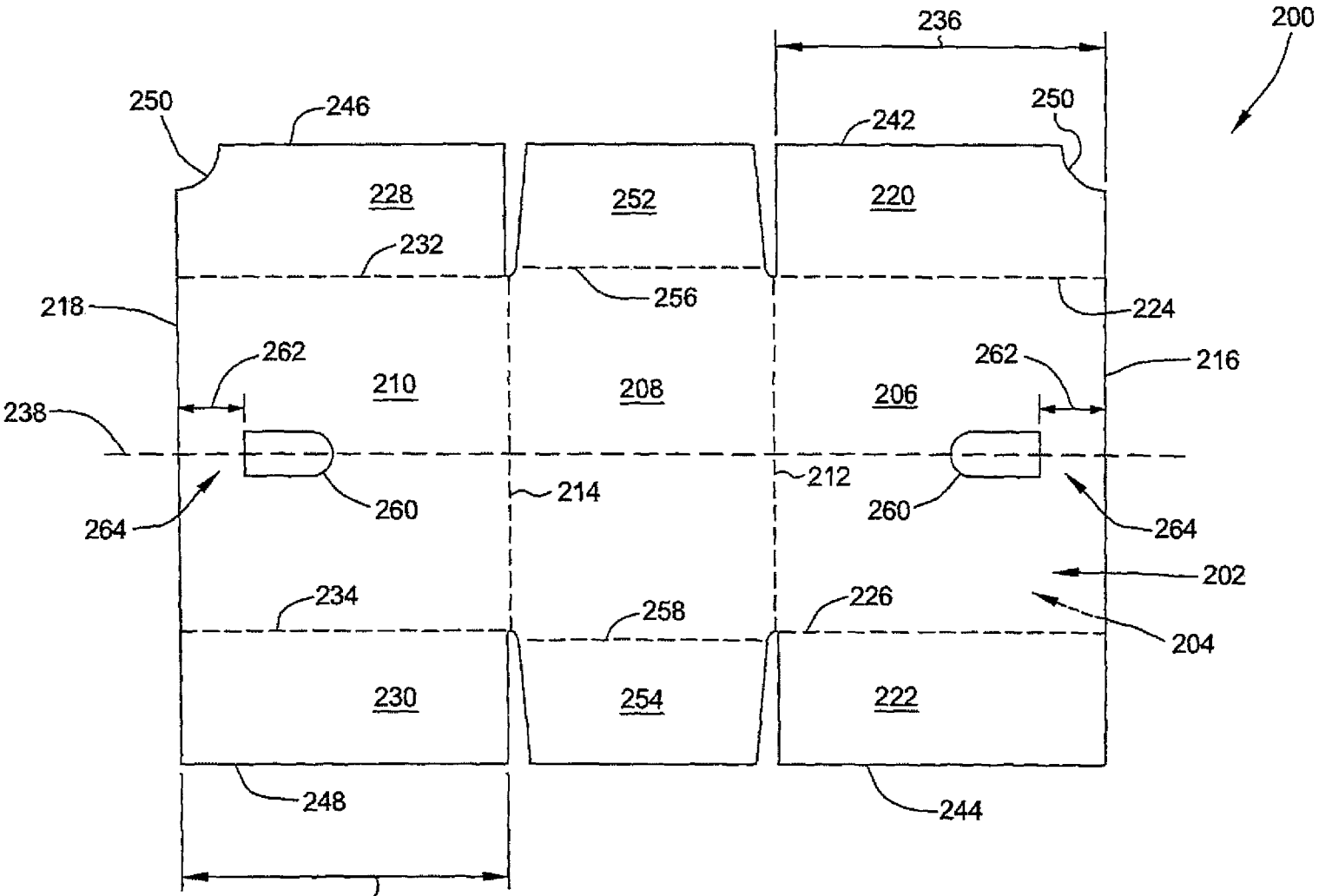
FIG. 2 is an exterior view of an example embodiment of a cover blank of sheet material that may be used with the blank shown in FIG. 1 to form the shipping dispenser container described herein.
Figure 3:
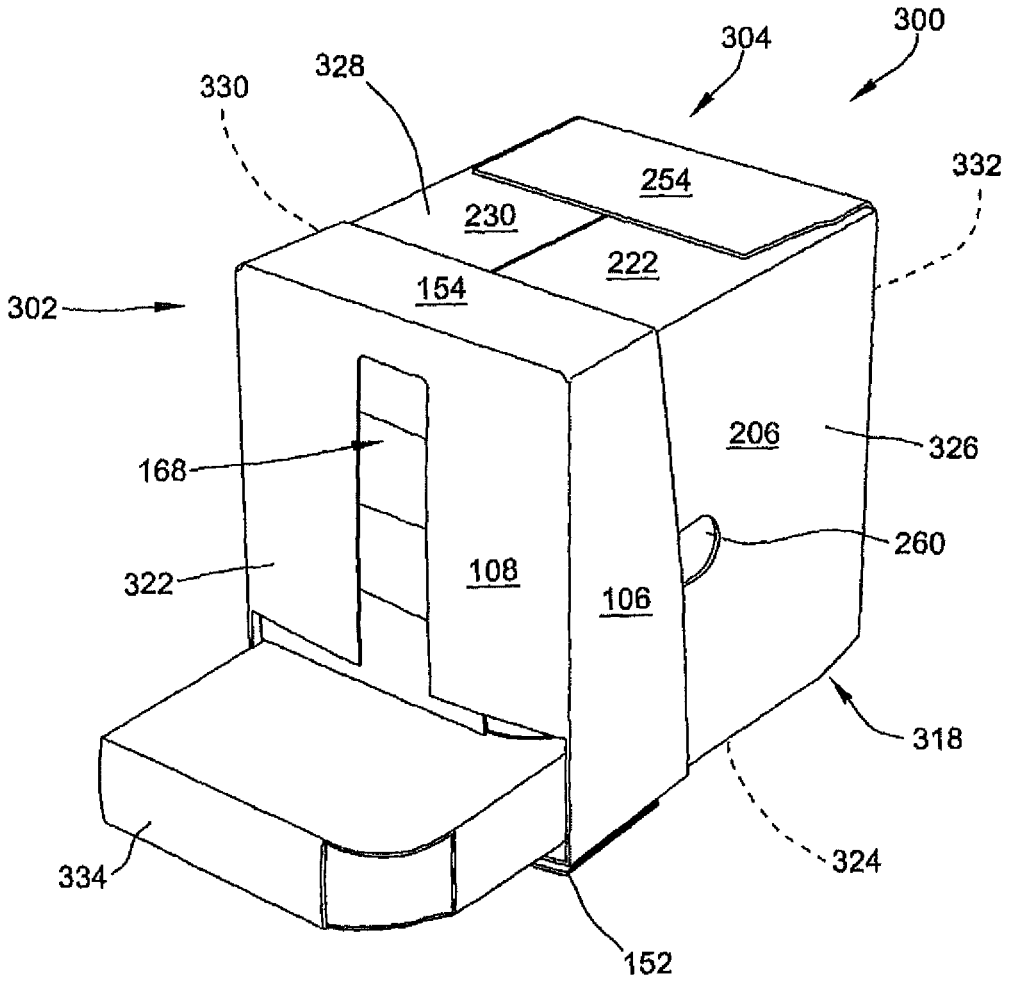
FIG. 3 is a perspective view of an example embodiment of a shipping dispenser container formed by the blanks shown in FIGS. 1 and 2 in a gravity-feed configuration.
Figure 4:
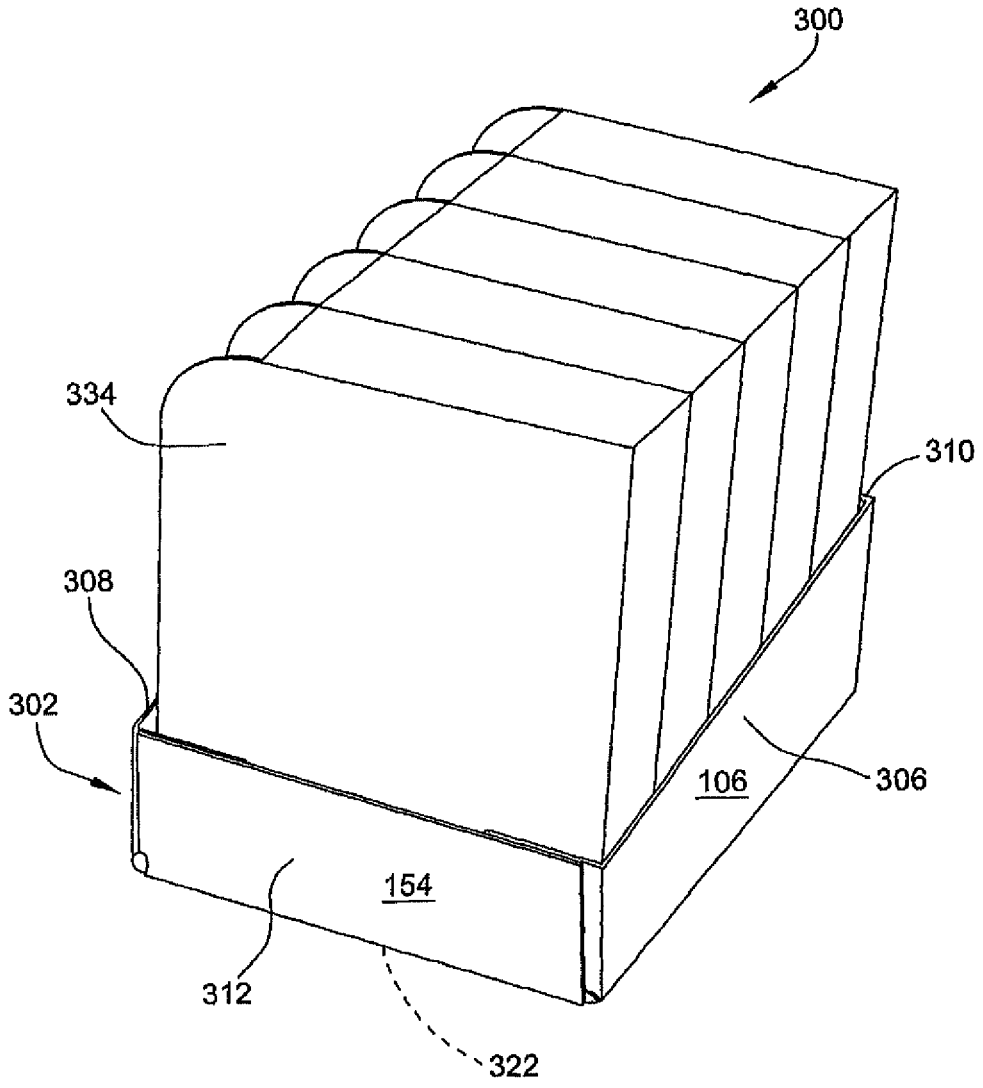
FIG. 4 is a perspective view of the shipping dispenser container shown in FIG. 3 in a display tray configuration.

FIG. 2 is an exterior view of an example embodiment of a cover blank 200 of sheet material that is configured to releasably couple to tray blank 100 (shown in FIG. 1) to form shipping dispenser container 300 (shown in FIGS. 3-5). In the example embodiment, cover blank 200 includes an exterior side 202 and an interior side 204. As shown in FIG. 2, cover blank 200 includes a series of aligned side panels and end panels connected together by a plurality of preformed, generally parallel, fold lines. Specifically, the side panels include a first side panel 206, an end panel 208, and a second side panel 210 connected in series along a pair of fold lines 212 and 214. First side panel 206 extends from a free edge 216 to fold line 212, end panel 208 extends between first and second side panels 206 and 210 from fold line 212 to fold line 214, and second side panel 210 extends from end panel 208 at fold line 214 to a second free edge 218.

A first side flap 220 and a second side flap 222 extend from opposing edges of first side panel 206. More specifically, first side flap 220 and second side flap 222 extend from first side panel 206 along a pair of opposing preformed, generally parallel, fold lines 224 and 226, respectively. Similarly, a third side flap 228 and a fourth side flap 230 extend from opposing side edges of second side panel 210. More specifically, third side flap 228 and fourth side flap 230 extend from second side panel 210 along a pair of opposing preformed, generally parallel, fold lines 232 and 234, respectively. Fold lines 224, 226, 232, and 234 are generally parallel to each other and generally perpendicular to fold lines 212 and 214. Free edges 216 and 218 are generally parallel to fold lines 212 and 214 such that side flaps 220, 222, 228, and 230 each have a width 236 taken along a central horizontal axis 238 of cover blank 200.

First side flap 220 and second side flap 222 each include a free edge 242 or 244, respectively. Similarly, third side flap 228 and fourth side flap 230 each include a free edge 246 or 248, respectively. First side flap 220 and third side flap 228 each include an arcuate edge 250. Specifically, arcuate edge 250 on first side flap 220 extends from free edge 242 to free edge 216. Similarly, arcuate edge 250 on third side flap 228 extends from free edge 218 to free edge 246. The shape, size, and arrangement of side flaps 220, 222, 228, and 230 as shown in FIG. 2 and described above facilitates forming a rectangular shipping dispenser container 300 having cutouts, as shown in FIG. 5.

As shown in FIG. 2, a first end flap 252 and a second end flap 254 extend from opposing edges of end panel 208. More specifically, first end flap 252 and second end flap 254 extend from end panel 208 along a pair of opposing preformed, generally parallel, fold lines 256 and 258, respectively. Side panels 206 and 210 each include a cutout 260 spaced a distance 262 from free edges 216 and 218. Cutouts 260 are configured for providing access to a user for separating the cover portion from the tray portion when shipping dispenser container 300 is formed. Furthermore, side panels 206 and 210 each include an adhesive area 264 positioned between cutout 260 and free edges 216 and 218 within distance 262. Adhesive areas 264 are configured to accept an adhesive to establish a paperboard-to-paperboard bond that couples cover blank 200 to tray blank 100. Specifically, adhesive areas 264 on exterior 202 of each of side panels 206 and 210 are configured to bond to a corresponding portion on interior 104 of each of side panels 106 and 110 to form shipping dispenser container 300.

In the example embodiment, cover blank 200 is formed from a corrugated paperboard material. Specifically, cover blank 200 is formed from a corrugated paperboard material having a "B" flute size corrugation, which includes a thickness of approximately ⅛ in., and that includes a plurality of flutes (not shown) oriented substantially parallel to fold lines 212 and 214. In the example embodiment, cover blank 200 is formed from a corrugated paperboard material that is approximately twice the thickness of tray blank 100. The plurality of flutes are configured in such an orientation to provide stacking strength to shipping dispenser container 300 during shipping and storage. Such a configuration is different from many known containers in that many known containers include flutes that would extend parallel to axis 238 in an orientation that enables the flutes to have the longest possible length. Alternatively, cover blank 200 may be formed from any size flute paperboard material that facilitates operation of shipping dispenser container 300 as described herein, or cover blank 200 may be formed from a folding carton paperboard material.

FIG. 3 is a perspective view of an example embodiment of a shipping dispenser container 300 formed by blanks 100 and 200 shown in FIGS. 1 and 2 in a gravity-feed configuration. FIG. 4 is a perspective view of shipping dispenser container 300 in a display tray configuration. FIG. 5 is perspective view of shipping dispenser container 300 shown in FIGS. 3 and 4 during an example packing process. Shipping dispenser container 300 includes a tray portion 302 formed by tray blank 100 and a cover portion 304 formed by cover blank 200.

In the gravity-feed configuration shown in FIG. 3, tray portion 302 and cover portion 304 cooperate to form a first end wall 324 and an opposing second end wall 328, and a first side wall 326 and an opposing second side wall 330, of shipping dispenser container 300. In addition, tray portion 302 forms a first wall 322 of shipping dispenser container 300, and cover portion 304 forms an opposing second wall 332 of shipping dispenser container 300. More specifically, first end wall 324 includes first end flap 152, first side flap 120, and third side flap 128 of tray blank 100 and first end flap 252, first side flap 220, and third side flap 228 of cover blank 200. First side wall 326 includes first side panel 106 of tray blank 100 and first side panel 206 of cover blank 200. Second end wall 328 includes second end flap 154, second side flap 122, and fourth side flap 130 of tray blank 100 and second end flap 254, second side flap 222, and fourth side flap 230 of cover blank 200. Second side wall 330 includes second side panel 110 of tray blank 100 and second side panel 210 of cover blank 200. First wall 322 includes end panel 108 of tray blank 100, and second wall 332 includes end panel 208 of cover blank 200.

In certain embodiments, shipping dispenser container 300 is oriented in the gravity-feed configuration such that first end wall 324 is a bottom wall, second end wall 328 is a top wall, and first wall 322 is a front wall of shipping dispenser container 300. Moreover, arcuate edges 150 and 250 are configured to correspond with a portion of cutout 172 on first end wall 324 such that the portion of cutout 172 on first wall 322 provides a leverage means for a user to detach removable panel 160 from first wall 322. Separation of removable panel 160 facilitates allowing a user to remove a product 334 from shipping dispenser container 300 through first wall 322 in the gravity-feed configuration. When a first product 334 is removed from shipping dispenser container 300 in the gravity-feed configuration, a second product 334 falls into the space formerly occupied by the first product 334 and is then itself available for removal through the opening created by removal of removable panel 160. In addition, cutout 168 allows the user to visually determine the number of products 334 remaining in shipping dispenser container 300. It should be understood that in alternative embodiments, shipping dispenser container 300 may be oriented otherwise in the gravity-feed configuration.

In the display tray configuration shown in FIG. 4, cover portion 304 (shown in FIG. 3) is removed from shipping dispenser container 300. Cover portion 304 is configured to cover and protect products 334 during shipping and storage of shipping dispenser container 300. Removal of cover portion 304 exposes products 334 and converts shipping dispenser container 300 into the display tray configuration. Such conversion is performed by rotating shipping dispenser container 300 ninety degrees about fold line 156 such that first wall 322 becomes a bottom wall of shipping dispenser container 300 and second end wall 328 becomes a front wall of shipping dispenser container 300. A user removes cover portion 304 by, for example, inserting the user's fingers into cutout 260 (shown in FIG. 3) and breaking an adhesive bond between first side panel 106 of tray portion 302 and adhesive area 264 on first side panel 206 of cover portion 304, and between second side panel 110 of tray portion 302 and adhesive area 264 on second side panel 210 of cover portion 304. Cover portion 304 is then lifted from tray portion 302. In such a configuration, a greater portion of products 334 are displayed to a consumer than in the gravity-feed configuration.

In certain embodiments in the display tray configuration, shipping dispenser container 300 includes a first side wall 306 and an opposing second side wall 308, a first end wall 310 and an opposing second end wall 312, and first wall 322 as a bottom wall. More specifically, first side wall 306 includes first side panel 106 of tray blank 100, first end wall 310 includes first end flap 152, first side flap 120, and third side flap 128 of tray blank 100, second side wall 308 includes second side panel 110 of tray blank 100, second end wall 312 includes second end flap 154, second side flap 122, and fourth side flap 130 of tray blank 100, and first wall 322 includes end panel 108 of tray blank 100.

In certain embodiments, shipping dispenser container 300 is initially formed in a shipping and storage configuration. FIG. 5 is perspective view of shipping dispenser container 300 during an example packing process. Shipping dispenser container 300 in loading configuration 400 includes tray portion 302 and cover portion 304 each formed partially and coupled together to form shipping dispenser container 300 with, for example, one of first end wall 324 and second end wall 328 remaining open to facilitate loading of products 334. Configuration 500 shows shipping dispenser container 300 in the loading configuration with products 334 loaded therein. Shipping and storage configuration 600 illustrates shipping dispenser container 300 in a closed state for shipping and storage, with the one of first end wall 324 and second end wall 328 closed. Configuration 700 illustrates shipping dispenser container 300 in the gravity-feed configuration, and configuration 800 shows shipping dispenser container 300 in the alternative display tray configuration. In alternative embodiments, tray portion 302 and cover portion 304 are formed and coupled together in any other suitable sequence. For example, at least one of tray portion 302 and cover portion 304 is formed completely before tray portion 302 and cover portion 304 are coupled together and/or before products 334 are loaded to form shipping dispenser container 300.

With reference to FIGS. 1-5, in the illustrated embodiment, to form shipping dispenser container 300 in loading configuration 400, tray portion 302 is at least partially formed. More specifically, first and second side panels 106 and 110 are folded along fold lines 112 and 114, respectively, towards interior side 104 of tray blank 100 to form a first portion of first side wall 326 and a first portion of second side wall 330, respectively. Second and fourth side flaps 122 and 130 are each folded inwardly toward end panel 108 at respective fold lines 126 and 134 such that side flaps 122 and 130 are substantially perpendicular to their associated side panels 106 and 110. Second end flap 154 is folded along fold line 158 toward interior side 104 of end panel 108 such that second end flap 154 is substantially perpendicular to end panel 108 and at least partially overlaps second and fourth side flaps 122 and 130. Adhesive is applied to at least one of interior side 104 of second end flap 154 and exterior sides 102 of second and fourth side flaps 122 and 130, such that second end flap 154 and second and fourth side flaps 122 and 130 form a first portion of second end wall 328.

Similarly, cover portion 304 is at least partially formed. More specifically, first and second side panels 206 and 210 are folded along fold lines 212 and 214, respectively, towards interior side 204 of cover blank 200 to form a second portion of first side wall 326 and a second portion of second side wall 330, respectively. Side flaps 222 and 230 are then each folded inwardly toward end panel 208 at their respective fold lines 226 and 234 such that side flaps 222 and 230 are substantially perpendicular to their associated side panels 206 and 210. Next, second end flap 254 is folded along fold line 258 toward interior side 204 of end panel 208 such that second end flap 254 is substantially perpendicular to end panel 208 and at least partially overlaps second and fourth side flaps 222 and 230. Adhesive is applied to at least one of interior side 204 of second end flap 254 and exterior sides 202 of second and fourth side flaps 222 and 230, such that second end flap 254 and second and fourth side flaps 222 and 230 form a second portion of second end wall 328.

In certain embodiments, to couple the partially formed tray and cover portions 302 and 304 together to form shipping dispenser container 300 in loading configuration 400, adhesive is applied to at least one of areas 264 on exterior 202 of each of side panels 208 and 210 of cover portion 304 and the corresponding portions on interior 104 of each of side panels 106 and 110 of tray portion 302. The partially formed cover portion 304 is then inserted into the partially formed tray portion 302 such that the first and second portions of second end wall 328, first side wall 326, and second side wall 330 overlap to form shipping dispenser container 300 in configuration 400, such that the adhesive secures the partially formed tray and cover portions 302 and 304 together. In alternative embodiments, the partially formed tray and cover portions 302 and 304 are secured together using any suitable fastener at any suitable location on tray portion 302 and/or cover portion 304.

In the example embodiment, products 334 are loaded into shipping dispenser container 300 before container first end wall 324 is formed. Accordingly, as shown in configurations 400, 500, and 600, after shipping dispenser container 300 is loaded with product 334, first and third side flaps 220 and 228 and first end flap 252 of cover portion 304, and first end flap 152 and first and third side flaps 120 and 128 of tray portion 302, are rotated about their respective fold lines and coupled together in a similar fashion as described above for second end wall 328. Alternatively, first end wall 324 may be formed initially and product 334 may be loaded into shipping dispenser container 300 before second end wall 328 is formed, such that second end flap 154 and second and fourth side flaps 122 and 130 of tray portion 302, and second end flap 254 and second and fourth side flaps 222 and 230 of cover portion 304, are coupled together after shipping dispenser container 300 is loaded with product 334. For example, although the embodiment of FIG. 5 illustrates shipping dispenser container 300 as being rotated 180 degrees between loading configuration 400 and gravity-feed configuration 700, in alternative embodiments no rotation is necessary between loading configuration 400 and gravity-feed configuration 700.

In the example embodiment, products 334 are food products configured to be packaged within shipping dispenser container 300 in an unfrozen state and then placed in a freezer for freezing. Accordingly, in order to avoid uneven distribution of the unfrozen food within product 334 during shipping and storage of shipping dispenser container 300, product 334 is packaged within shipping dispenser container 300 when container is in the gravity-feed configuration orientation, such that each product 334 is generally horizontal. Once the food within product 334 is frozen, a user may choose to display shipping dispenser container 300 in the gravity-feed configuration by detaching removable panel 160 from first wall 322, or a user may elect to display shipping dispenser container 300 in the display tray configuration by rotating shipping dispenser container 300 such that first wall 322 becomes a bottom wall and removing cover portion 304 from tray portion 302, as described above. Such an election may depend on a user's space allotment for shipping dispenser container 300 or an amount of shipping dispenser container 300 or product 334 the user desires to be displayed to a consumer.

Furthermore, to provide stacking strength to shipping dispenser container 300 during shipping and storage, the flutes of both tray portion 302 and cover portion 304 extend longitudinally between first end wall 324 and second end wall 328. Such an orientation of the flutes facilitates stacking multiple shipping dispenser containers 300 on top of each other in the gravity-feed configuration.

Moreover, in the example embodiment, end walls 324 and 328 include a single thickness of end flaps 252 and 254, respectively, each positioned opposite a double thickness of an end flap 152 or 154 and two associated side flaps 120 and 128 or 122 and 130. However, each of end walls 324 and 328 is substantially level because tray portion 302 is formed from a corrugated paperboard material that has half the thickness of the corrugated paperboard material from which cover portion 304 is formed. Specifically, as described above, tray portion 302 is formed from "E" flute size corrugation, and cover portion 304 is formed from "B" flute size corrugation. Such a configuration enables multiple shipping dispenser containers 300 to be stacked on one another while remaining substantially level. If each end flap 152 or 154 and its two associated side flaps 120 and 128 or 122 and 130 combined to form a different thickness from end flaps 252 and 254, then the difference in thickness would cause a stack of shipping dispenser containers 300 to lean towards whichever portion of the wall had a lesser thickness. Forming cover portion 304 and tray portion 302 from different flute size corrugations prevents this from occurring.

In contrast to at least some known containers, in the methods and apparatus described herein, the shipping dispenser container is formed from two blanks having substantially vertical flute orientations. As a result, the shipping dispenser container may be selectively displayed in one of a gravity-feed configuration or a display tray configuration. Thus a user may elect to display the shipping dispenser container in the gravity-feed configuration by simply detaching a removable panel and displaying the container in the same orientation in which it was shipped and stored, or a user may elect to display the container in the display tray configuration by rotating the container 90 degrees and removing the cover portion. The gravity-feed configuration enables a consumer to remove the product from the shipping dispenser container through a slot formed by the removal of the removable panel. Further, the gravity-feed configuration includes a viewing window to allow a user to determine the amount of product remaining within the shipping dispenser container.

Example embodiments of a container formed from blanks are described above in detail. The container and blanks are not limited to the specific embodiments described herein, but rather, components of the blanks and/or container may be utilized independently and separately from other components and/or steps described herein.

The example embodiments of the containers described herein can be formed by a plurality of container-forming machines including machines using a mandrel forming apparatus or a plunger forming apparatus that facilitates wrapping the blank around these devices to form the containers. The machines are configured to use servomechanisms and other mechanisms to control different parts of the machine for forming the containers. These machines are configured to form the containers described herein at a high rates of speed. In the example embodiments, the containers are formed on such machines using a two-step process. The first step of the process includes positioning and attaching the tray blank to the cover blank so that the two blanks form a blank assembly. The second step of the process includes wrapping the blank assembly around the mandrel or plunger to form the container. As used herein, the terms "servo-actuated" and "servo-controlled" refers to any component and/or device having its movement controlled by a servomechanism.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to illustrate the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for forming a convertible shipping container for goods, said method comprising:

forming a tray portion from a tray blank, the tray portion including a first wall;

removably coupling a cover portion to the tray portion; and selectively orienting the tray portion in one of a first display configuration and a second display configuration, wherein the first wall is configured to be oriented as a front wall of the convertible shipping container in the first display configuration and as a bottom wall of the convertible shipping container in the second display configuration, and wherein the cover portion is coupled to the tray portion in the first display configuration and is detachable from the tray portion to form the second display configuration;

wherein the second display configuration is a display tray configuration, wherein said first wall is configured to be oriented as a bottom wall of the convertible shipping container in the display tray configuration, wherein two side walls and two end walls extend upwards from the bottom wall of the convertible shipping container in the display tray configuration;

wherein said first wall includes a removable panel configured to be detached from said first wall to enable a user to remove the goods through said first wall when the convertible shipping container is in the first display configuration.

2. The method in accordance with claim 1, wherein selectively orienting the tray portion in the first display configuration comprises orienting the convertible shipping container to dispense the goods individually.

3. The method in accordance with claim 1, wherein selectively orienting the tray portion in the second display configuration comprises orienting the convertible shipping container to enable access to all of the goods within the convertible shipping container.

4. The method in accordance with claim 1, wherein forming the tray portion comprises forming the tray portion from the tray blank having a first thickness, and removably coupling the cover portion to the tray portion comprises removably coupling the cover portion formed from a cover blank having a second thickness, wherein the second thickness is approximately twice the first thickness.

5. The method in accordance with claim 1, wherein selectively orienting the tray portion in the first display configuration comprises orienting a first end wall of the convertible shipping container as a bottom wall in the first display configuration and selectively orienting the tray portion in the second display configuration comprises orienting the first end wall of the convertible shipping container as a rear wall in the second display configuration, wherein the first end wall of the convertible shipping container extends from and is perpendicular to the first wall of the tray portion.

6. The method in accordance with claim 1, wherein forming the tray portion comprises forming the tray portion that includes a viewing window configured to enable a user to view the goods when the tray portion is in the first display configuration.

7. The method in accordance with claim 1, wherein forming the tray portion comprises forming the tray portion that includes a removable panel configured to be detached from the first wall to enable a user to remove the goods through the first wall.

8. The method in accordance with claim 1, wherein orienting the tray portion in the first display configuration comprises orienting the convertible shipping container in a gravity-feed configuration.

9. The method in accordance with claim 1, further comprising at least partially transitioning from the first display configuration to the second display configuration by rotating the tray portion 90 degrees.

10. The method in accordance with claim 1, further comprising orienting the tray portion and the cover portion in an orientation that is rotated 180 degrees about a horizontal axis from the first display configuration during at least one of loading, shipping, and storage of the goods in the convertible shipping container.

11. The method in accordance with claim 1, wherein removably coupling the cover portion to the tray portion includes removably coupling the cover portion that includes a pair of opposing side walls and a rear wall that spaces the opposing side walls, wherein the rear wall of the cover portion is parallel to the first wall of the tray portion in the first display configuration, and wherein the side walls and rear wall of the cover portion and the first wall of the tray portion each include a plurality of flutes that are vertically oriented in the first display configuration.

12. The method in accordance with claim 1, wherein forming the tray portion comprises coupling a first end panel of the tray blank in overlapping relationship with a side flap of the tray blank to form a first portion of a first end wall of the convertible shipping container, and removably coupling the cover portion to the tray portion comprises forming a second portion of the first end wall of the convertible shipping container from a first end flap of the cover portion, wherein the first end panel of the tray blank, the side flap of the tray blank, and the first end flap of the cover portion are configured such that the first end wall of the convertible shipping container is substantially level.

13. A method for forming a convertible shipping container for goods, said method comprising:

forming a tray portion from a tray blank, the tray portion including a first wall;

removably coupling a cover portion to the tray portion; and selectively orienting the tray portion in one of a first display configuration and a second display configuration, wherein the first wall is configured to be oriented as a front wall of the convertible shipping container in the first display configuration and as a bottom wall of the convertible shipping container in the second display configuration, and wherein the cover portion is coupled to the tray portion in the first display configuration and is detachable from the tray portion to form the second display configuration;

wherein selectively orienting the tray portion in one of the first display configuration and the second display configuration comprises orienting the tray portion and the cover portion in the first display configuration during loading, shipping, and storage of the goods in the convertible shipping container.

* * * * *